United States Patent [19]

Chandhok

[11] 3,992,200

[45] Nov. 16, 1976

[54] METHOD OF HOT PRESSING USING A GETTER

[75] Inventor: Vijay K. Chandhok, Pittsburgh, Pa.

[73] Assignee: Crucible Inc., Pittsburgh, Pa.

[22] Filed: Apr. 7, 1975

[21] Appl. No.: 565,878

[52] U.S. Cl. ..... 75/211; 75/200; 75/225; 75/226; 75/214; 264/111

[51] Int. Cl.[2] ..... B22F 3/14

[58] Field of Search ..... 75/200, 214, 225, 226, 75/211; 264/111

[56] References Cited

UNITED STATES PATENTS

| | | | |
|---|---|---|---|
| 3,364,976 | 1/1968 | Reding et al. | 75/225 |
| 3,627,521 | 12/1971 | Vordahl | 75/226 |
| 3,700,435 | 10/1972 | Chandhok | 75/226 |
| 3,899,821 | 8/1975 | Ito et al. | 75/226 |

*Primary Examiner*—Brooks H. Hunt

[57] ABSTRACT

A method and assembly for producing compacted powder metallurgy articles wherein powdered metal of a composition corresponding to that desired in the article is introduced to a porous mold corresponding generally to the desired configuration of the article, the mold is placed in a container sealed against the atmosphere and having a secondary pressure media in solid, particle form therein and surrounding the mold. This assembly is heated to elevated temperature for compacting and compacted by the application of pressure to the assembly. The improvement of the invention comprises mixing with the secondary pressure media a reactive metal selected from the group consisting of titanium, zirconium, hafnium and mixtures thereof, which acts as a getter for impurities, such as oxygen and nitrogen, present in the secondary pressure media. This prevents oxide and nitride formation in the final compacted article.

4 Claims, 1 Drawing Figure

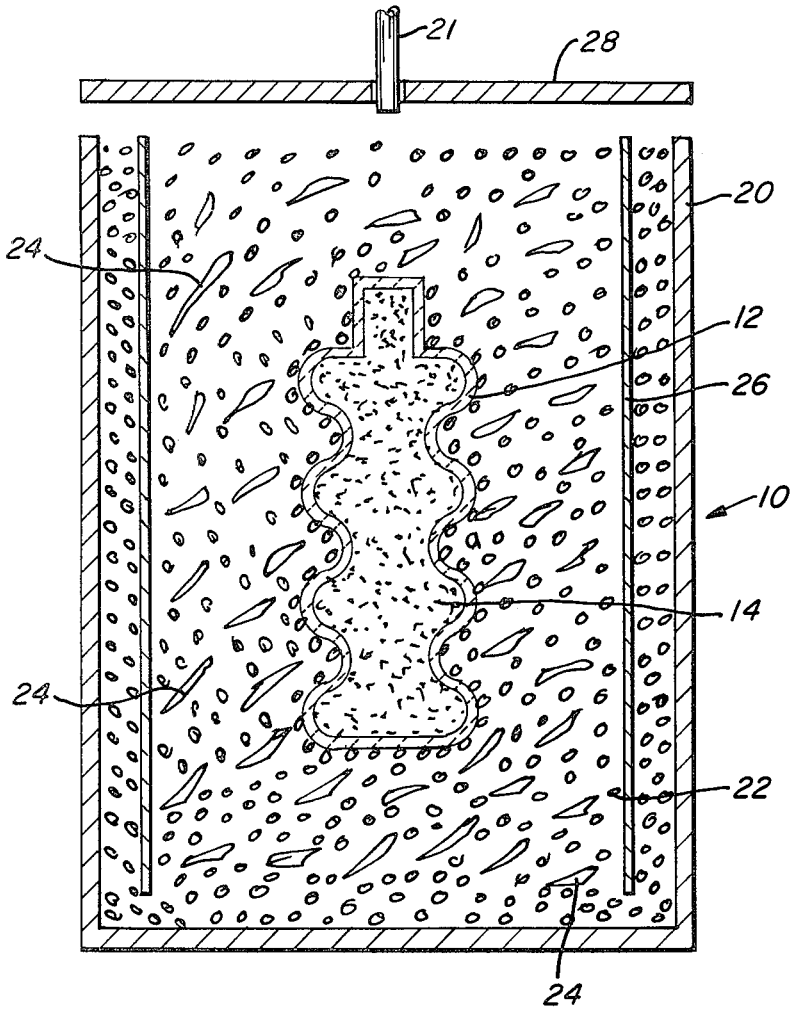
21
28
20
24
12
26
10
14
24
22
24

METHOD OF HOT PRESSING USING A GETTER

It is known in powder metallurgy practice to take a charge of powdered metal, and particularly prealloyed alloy powder, place the same in a porous mold having a shape corresponding substantially to that desired in the final article and made of a refractory material such as silica, zircon, alumina or mixtures thereof, place the same in a sealable container having a secondary pressure media in solid particle form therein and surrounding said mold, and then heat this assembly to an elevated temperature at which time the powder is compacted by the application of pressure to the exterior of the assembly, such as fluid pressure by the use of an autoclave. In powder metallurgy articles, and particularly superalloys and high speed steels, it is desirable that the compacted products be characterized by the absence of oxides and nitrides. Consequently, it is customary during the initial stages of heating or in a separate preheating step to evacuate the interior of the container at which time oxygen and nitrogen are removed from the container interior by pumping action. It has been found, however, that in applications of this type where a relatively large mass of secondary pressure media is employed many times the customary pumping action at an intermediate temperature does not remove all of the oxygen and nitrogen, particularly from the areas of the container interior remote from the connection to the vacuum pump. In instances such as this, upon further heating, sealing of the container and compacting any oxygen or nitrogen not removed may be present in the compacted article in the form of oxides and nitrides. Particularly in the case of superalloys and high speed steels, which are characterized by alloying elements that are readily reactive with oxygen and nitrogen, this is most apt to occur.

It is accordingly a primary object of the present invention to provide a method for producing powder metallurgy shapes wherein a getter is supplied within the sealed container to absorb any impurities, such as oxygen and nitrogen, not removed during the outgassing sequence and thereby prevent them from affecting the alloy powder to be compacted.

This and other objects of the invention as well as a more complete understanding thereof may be obtained from the following description, specific examples and drawings, in which:

The single FIGURE thereof is a schematic showing of an assembly suitable for use in the practice of the invention.

The invention is applicable to practices wherein a charge of powdered metal, particularly prealloyed powder, to be compacted, is introduced to a porous mold corresponding generally to the configuration desired in the article. The mold filled with the powder is placed in a suitable container having a secondary pressure media therein, which preferably completely surrounds the mold. This assembly is then heated to an elevated temperature suitable for compacting, which temperature will depend generally upon the composition of the powdered metal charge to be compacted. Finally the assembly is placed in an autoclave for compacting of the powder by the application of fluid pressure while at elevated temperature. To achieve the desired final product quality, and particularly the absence of deleterious oxides and nitrides, it is customary to subject the interior of the container to outgassing which step is conducted prior to heating to the elevated temperature for compacting. Usually outgassing is performed either during the initial stages of heating to compacting temperature or during a separate heating operation.

The mold may be constructed of a material that is inert with respect to the alloy of the powder of the compact. For this purpose, silica, zircon, alumina, and mixtures thereof may be used. These same materials in particle form, but preferably zircon, may be used as the secondary pressure media.

During compacting densities approaching 100% of theoretical are achieved, and when fluid pressure compacting is used pressures within the range of 10,000 to 30,000 psi are suitable for the purpose. For materials such as steel, compacting temperatures on the order of about 1800° to 2300° F may be employed, and typically the alloyed powder will be of a size not larger than about minus 30 mesh U.S. Standard. Suitable outgassing temperatures are typically about 400° to 500° F. After compacting, the mold is removed from the container and secondary pressure media. The mold is removed from the compact as by sand blasting.

With reference to the single FIGURE of the drawings there is shown an assembly suitable for use in the practice of the invention and designates generally as 10. The assembly consists of a mold 12, which may be of silica, zircon, alumina or mixtures thereof. The mold 12 is filled with a powdered charge 14, of the metal or alloy desired in the final product, which is generally prealloyed powder. During filling of the mold it is customary to agitate the same to insure complete filling with the powder charge. The mold 12 is placed in a container 20, which may be constructed of mild, carbon steel. The container 20 has a stem 21. The container is filled with a secondary pressure media 22, which may be silica, zircon, alumina or mixtures thereof in particle form, with zircon and alumina being preferred. Particles of a reactive metal such as titanium, zirconium, hafnium or mixtures thereof are substantially equally dispersed throughout the secondary pressure media 22; specifically as shown in the drawing the reactive metal may be chips or turnings, designated as 24. It is understood that the term "reactive metals" as used herein also includes base alloys of these metals. As may be seen from the drawing it is preferred that the secondary pressure media 22 completely surround the mold 12. In view of the highly reactive nature of the dispersed particles 24 it is preferred that they remain out of contact with the mold 20 which is of steel; otherwise, upon heating incident to outgassing and compacting the mold will deteriorate. For this purpose it is customary to provide within the container 20 a removable concentric tubular section 26 with the particles 24 being confined within the tubular section during filling of the container 20 with the reactive metal particles 24 and the particles of the secondary pressure media 22; after filling and prior to compacting the container is sealed as by welding thereto top closure 28. The tubular section 26 is removed, as by axially withdrawing it from the filled container, prior to this sealing operation. During filling of the container it is necessary that a bottom layer of the secondary pressure media 22 and a top layer thereof be maintained free of the particles 24 so that these particles are out of contact with the top and bottom of the container 12, which is generally of the same material as the tubular walls of the container.

With the assembly constructed as shown in the drawing—except for the tubular section 26 removed and the top 28 welded in place—the interior is subjected to outgassing. This requires the connection of the chamber interior via stem 21 to a suitable vacuum pump (not shown) for removal of gaseous reaction products produced during heating and particularly gaseous oxygen and nitrogen compounds. For this purpose heating to a relatively low temperature of about 400° to 500° F is generally satisfactory. Any oxygen or nitrogen not so removed will be absorbed by reaction with the reactive metal particles 24 during subsequent heating to compacting temperature. After outgassing, the container 20 is sealed by closing stem 21, the assembly is heated to the temperature necessary for compacting and then compacted by the application of pressure to the exterior of the container 20. For this purpose the well-known practice of hot isostatic compacting by the use of a fluid pressure vessel, commonly termed an "autoclave", is preferred.

By the combination of the pumping action typical of outgassing practices and the use of the reactive metal getter particles 24 in accordance with this invention, upon sealing of the container the interior thereof is free of oxygen and nitrogen and thus even though a porous material is used in the construction of mold 12 none of these impurities will be present to diffuse into the powdered alloy therein and thus be present in the final compacted product in the form of deleterious oxides and nitrides.

The following Table I reports oxygen and nitrogen contents for compacting operations both with and without the use of the reactive metal titanium as a getter. The oxygen and nitrogen contents are significantly lower for the compacts wherein titanium was used as a "getter" in accordance with the practice of the invention.

TABLE I

| Compact Code | Superalloy* Composition | Mold Material | Secondary Pressing Media | Getter | Compacting Temp./ Pressure | $O_2$ (ppm) | $N_2$ (ppm) | Analysis No. |
|---|---|---|---|---|---|---|---|---|
| SM95 | Rene 95 | $SiO_2$ | $SiO_2$ | None | 2000F/ 15 ksi | 103,136 | 184,186 | 75-161 |
| SM96 | Rene 95 | $SiO_2$ | $SiO_2$ | Ti Sheet | 2000F/ 15 ksi | 73,73 | 84,84 | 75-162 |
| 1 | PA-101 | $SiO_2$ | $Al_2O_3$ | None | 2175F/ 15 ksi | 180,152 | 77,59 | 75-139 |
| 3 | PA-101 | $SiO_2$ | $Al_2O_3$ | Ti Powder | 2175F/ 15 ksi | 46,90 | 32,65 | 75-140 |
| 23 | PA-101 | $SiO_2$ | $Al_2O_3$ | None | 2100F/ 15 ksi | 208,219 | 91,63 | 75-141 |
| 25 | PA-101 | $SiO_2$ | $Al_2O_3$ | Ti Powder | 2100F/ 15 ksi | 33,48 | 34,40 | 75-142 |

*Compositions in weight percent:
Rene 95-C .07, Cr 14, Co 8, Ti 2.5, Al 3.5, Mo 3.5, B .01, W 3.5, Cb 3.5, Zr .05, Ni Bal.
PA-101-C .17, Cr 12.5, Co 9, Mo 1.9, Ta 3.9, Ti 4.1, Al 3.4, Hf 1.0, B .01, Zr .10, Ni Bal.

The term powdered metal as used herein is intended to include prealloyed powder including that formed by conventional atomization of molten alloy.

I claim:

1. In a method for producing a compacted powder metallurgy article by forming an assembly by introducing powder metal to a porous mold corresponding generally to the configuration of said article and placing said mold in a container sealed against the atmosphere and having a secondary pressure media in solid, particle form therein, outgassing said assembly, heating said assembly to elevated temperature for compacting and compacting said powder by the application of pressure to said assembly while at elevated temperature, the improvement comprising mixing with said secondary pressure media a reactive metal selected from the group consisting of titanium, zirconium, hafnium, and mixtures thereof, whereby during said heating the reactive metal absorbs oxygen and nitrogen present with the secondary pressure media.

2. The method of claim 1 wherein said container is steel and said reactive metal is maintained out of contact therewith within said secondary pressure media.

3. The method of claim 1 wherein said reactive metal is titanium.

4. The method of claim 2 wherein said reactive metal is substantially evenly dispersed throughout said secondary pressure media.

* * * * *

UNITED STATES PATENT OFFICE

CERTIFICATE OF CORRECTION

Patent No. 3,992,200 Dated November 16, 1976

Inventor(s) Vijay K. Chandhok

It is certified that error appears in the above-identified patent and that said Letters Patent are hereby corrected as shown below:

Columns 3 and 4, TABLE I, footnote line 3, in the composition for PA-101, after 'Mo 1.9" insert --W 3.9--.

Signed and Sealed this

Eleventh Day of January 1977

[SEAL]

*Attest:*

RUTH C. MASON
*Attesting Officer*

C. MARSHALL DANN
*Commissioner of Patents and Trademarks*